US010058160B2

(12) United States Patent
Chen

(10) Patent No.: US 10,058,160 B2
(45) Date of Patent: Aug. 28, 2018

(54) AIRTIGHT CONTAINER FOR COSMETICS

(71) Applicant: Suzhou MYC Packaging Innovation Ltd., Suzhou, Jiangsu (CN)

(72) Inventor: Wensheng Chen, Suzhou (CN)

(73) Assignee: Suzhou MYC Packaging Innovation Ltd. (CN)

( * ) Notice: Subject to any disclaimer, the term of this patent is extended or adjusted under 35 U.S.C. 154(b) by 452 days.

(21) Appl. No.: 14/788,053

(22) Filed: Jun. 30, 2015

(65) Prior Publication Data

US 2016/0120290 A1 May 5, 2016

Related U.S. Application Data

(63) Continuation of application No. PCT/CN2014/090248, filed on Nov. 4, 2014.

(51) Int. Cl.

| | |
|---|---|
| ***A45D 40/24*** | (2006.01) |
| ***A45D 40/18*** | (2006.01) |
| ***A45D 40/06*** | (2006.01) |
| ***A45D 40/20*** | (2006.01) |
| ***A45D 40/28*** | (2006.01) |

(52) U.S. Cl.

CPC ..... *A45D 40/18* (2013.01); *A45D 40/06* (2013.01); *A45D 40/20* (2013.01); *A45D 40/28* (2013.01)

(58) Field of Classification Search

CPC ..... A45D 40/06; A45D 40/18; A45D 40/20; A45D 40/28; A45D 40/02; A45D 40/023; A45D 40/205; A45D 2040/0018; A45D 2040/0025; A45D 2040/208

See application file for complete search history.

(56) References Cited

U.S. PATENT DOCUMENTS 6,732,743 B1 * 5/2004 Bouix ..... A45D 40/0087 132/200
8,534,946 B2 * 9/2013 Cont ..... A45D 40/205 401/68
2004/0213624 A1 10/2004 Petit (Continued)

FOREIGN PATENT DOCUMENTS

CN 201048674 Y 4/2008
CN 202514864 U 11/2012

(Continued)

*Primary Examiner* — Rachel Steitz
(74) *Attorney, Agent, or Firm* — Forge IP, PLLC

(57) ABSTRACT

A cosmetic applicator including: a cosmetic supply mechanism; a bearing member to carry the cosmetic supply mechanism; a housing for forming a closed cavity together with bearing member to enclose the cosmetic supply mechanism disposed therein, the housing and the bearing member being designed to be connected edge to edge. The bearing member and the housing respectively have a first connection part and a second connection part for magnetic connection, and the first connection part and the second connection part is positioned respectively at the end of the bearing member and of the housing; and the cosmetic applicator includes a elastomeric gasket, and the first connection part, second connection part and elastomeric gasket are configured so the elastomeric gasket can be extruded to deform and fill a gap between the ends of the housing and the bearing member when the ends are mutually attracted, thereby achieving the sealing effect.

8 Claims, 12 Drawing Sheets

(56) References Cited

U.S. PATENT DOCUMENTS

| | | | | |
|---|---|---|---|---|
| 2009/0110464 | A1* | 4/2009 | Zhang | A45D 40/06<br>401/18 |
| 2011/0262206 | A1* | 10/2011 | Cont | A45D 40/205<br>401/88 |
| 2015/0110539 | A1* | 4/2015 | Huang | A45D 40/06<br>401/63 |

FOREIGN PATENT DOCUMENTS

| | | | |
|---|---|---|---|
| CN | 203073451 | U | 7/2013 |
| CN | 203252134 | U | 10/2013 |
| DE | 29908084 | U1 | 7/1999 |
| EP | 2281476 | A1 | 2/2011 |
| FR | 2923998 | A1 | 5/2009 |
| WO | 2012150406 | A1 | 11/2012 |

* cited by examiner

AIRTIGHT CONTAINER FOR COSMETICS

FIELD OF THE INVENTION

The present invention relates to a cosmetic ware, and particularly to a cosmetic applicator.

BACKGROUND OF THE INVENTION

At present, the commercially available lipstick, lip balm and the like are generally formed by tubular housings, thus they usually face a problem of sealing.

As most cosmetics in the lipsticks or the lip balms are liquid and paste, these internal cosmetics are prone to deterioration/ineffectiveness or dry-out/solidification in case of bad sealing, thereby affecting normal use.

Currently, a sealing effect is usually achieved by means of interference fit between a convex rib on one part of the container and a side wall of the other part of the container. However, this interference fit brings a poor experience for user and requires great efforts.

The sealing effect can also be achieved in another way by the cooperation of the male threads on one part of the container with the female threads on the other part. However, this sealing way is so inconvenient for use that a user has to operate in rotation for multiple revolutions to achieve sealing or opening.

SUMMARY OF THE INVENTION

An objective of the present invention is to provide a cosmetic applicator which is convenient in use and excellent in air-tightness.

In one aspect of the present invention, a cosmetic applicator is provided in accordance with the objective of the present invention, comprising:

a cosmetic supply mechanism;

a bearing member for carrying the cosmetic supply mechanism;

a housing for forming a closed cavity together with the bearing member to enclose the cosmetic supply mechanism therein, the bearing member and the housing being designed to be connected edge to edge by their respective first connection part and second connection part for magnetic connection, the first connection part and the second connection part being positioned respectively at an end of the bearing member and of the housing; and a elastomeric gasket, wherein the first connection part, the second connection part and the elastomeric gasket are configured so that:

the elastomeric gasket can be extruded to deform and then fill a gap between the ends of the housing and bearing member when the latter are mutually attracted;

the height or thickness of the elastomeric gasket does not affect the magnetic connection between the first and second connection parts;

the intensity of the magnetic connecting between the first and second connection parts is strong enough to ensure that the elastomeric gasket, if positioned between the two connection parts, can be deformed and deployed under the magnetic extrusion force for completely filling the gap between the two connection parts, thereby achieving a good sealing effect.

It has an advantage that: the elastomeric gasket may be extruded by the force generated from the attraction between the two connection parts, thereby achieving close contact and sealing effect. In addition, this sealing effect resulting from magnetic connection may provide a better user experience and a greater hand feel.

The elastomeric gasket in the present invention can be made from a rubber material, a silica gel material or any other organic polymer materials as long as they have a certain elasticity to create deformation.

Typically, in order to reduce the manufacturing cost, only one of the first connection part and the second connection part is a permanent magnet, and the other one may use a common iron ring, as long as the first connection part and the second connection part can be mutually attracted.

In some embodiments, the bearing member is provided with a first accommodating groove for accommodating the first connection part, and the housing is provided with a second accommodating groove for accommodating the second connection part.

The first accommodating groove and the second accommodating groove are provided to better fix the first connection part and the second connection part on the bearing member and the housing so that the two connection parts are not prone to fall off from the fixing positions.

In some embodiments, the elastomeric gasket is of an annular sheet structure. The annular sheet-shaped elastomeric gasket is covered on the first connection part and/or the second connection part.

The elastomeric gasket with the annular sheet structure can be easily manufactured and assembled. It may be fixed on the first and/or the second connection parts as long as the elastomeric gasket can deform and generate a sealing effect under the attracting force of the first and second connection parts.

In some embodiments, the elastomeric gasket is mated with the second connection part and it has a section with "r"-shaped structure. In particular, the elastomeric gasket comprises a vertical part and an extending part laterally extending therefrom. The extending part is of an arc-shaped structure projecting towards the second connection part and is covered over the first connection part, and the vertical part is positioned at a side of the first connection part.

On one hand, the elastomeric gasket can be mounted stably through the "r"-shaped structure; on the other hand, the extending part with the arc-shaped structure may be easier to deform under the extruding force, thereby easily realizing the sealing effect.

In some embodiments, the bearing member is connected with a cover body at the bottom, and the bottom is provided with a fixed base on which is arranged a cosmetic tool.

The cosmetic tool includes, but not limited to, a pencil, a brush, a wiping Q-tip or a sponge body and the like.

The user may make up by using the pencil, the brush, the wiping Q-tip or the sponge body and the like on the bearing member, without additionally carrying a separate cosmetic tool, thereby bringing greater convenience to the user.

In some embodiments, the bearing member is connected with a cover body at the bottom, and the bottom is inserted with a storage box. The storage box comprises a box body and a box cover. The box body and the box cover cooperate with each other to form an accommodating space for enclosing the cosmetics.

Some articles required during makeup, such as oil-absorbing sheets and the like, may be placed in the accommodating space for cosmetics, thereby bringing the convenience to user.

In some embodiments, a roll/stack of oil-absorbing sheets is placed in the storage box, and cutting teeth are arranged on one side of the box body or box cover.

The user can cut the oil-absorbing sheets through the cutting teeth, thus can take out a certain amount of the oil-absorbing sheets according to the actual requirement, thereby bringing the convenience to user.

In some embodiments, the cosmetic supply mechanism comprises a bottom cover, a threaded pipe, a first sleeve, a threaded rod, a top cover and a cosmetics raw material; wherein the bottom cover is of a tubular structure and is sleeved within the bearing member; the threaded pipe comprises a sleeving part provided with a convex rib and a threaded part sleeved inside one end of the bottom cover and is provided with internal threads on the inner wall for cooperating with external threads on the threaded rod; the first sleeve is in bayonet connection at one end with the convex rib of the sleeving part; the threaded rod is disposed within the threaded pipe; the top cover is fixed at the top of the threaded rod in such a manner that the threaded rod can make an up-and-down movement relative to the threaded pipe during the rotation of the threaded rod and then drives the top cover to make an up-and-down movement; and the cosmetic raw material is positioned inside the top cover and is driven to be lifted for use when the top cover is lifted.

The cosmetic raw material may be hidden into the first sleeve for storage when not used and be protruded out from the first sleeve for use by rotating the threaded rod.

In some embodiments, the cosmetic supply mechanism comprises an accommodating pipe, a second sleeve and a cosmetic raw material; wherein the accommodating pipe comprises an accommodating cavity and a threaded sleeve provided with external threads on the outer side wall cooperating with internal threads on the inner wall of the second sleeve. During the rotation of the second sleeve, the threaded sleeve can make an up-and-down movement relative to the second sleeve, which simultaneously drives the accommodating cavity to make an up-and-down movement. The cosmetic raw material is positioned in the accommodating cavity, and the cosmetic raw material is driven to be lifted for use when the accommodating cavity is lifted.

The cosmetic raw material may be hidden in the accommodating pipe for storage when not used and be protruded out from the accommodating pipe for use by the rotation of the second sleeve driven by the rotation of the bearing member.

In some embodiments, the elastomeric gasket is mainly positioned at the exterior of the region between the first connection part and the second connection part. Under this situation, the first connection part and the second connection part can be attracted completely, without space between them each other. After the complete attraction, more attractive force may be realized, thus ensuring the good fixation of the housing and bearing member and thus the more stable sealing effect of the elastomeric gasket.

DETAILED DESCRIPTION OF THE INVENTION

The present invention will be further described in detail below in conjunction with the accompanying drawings 1-20.

Figure 20:
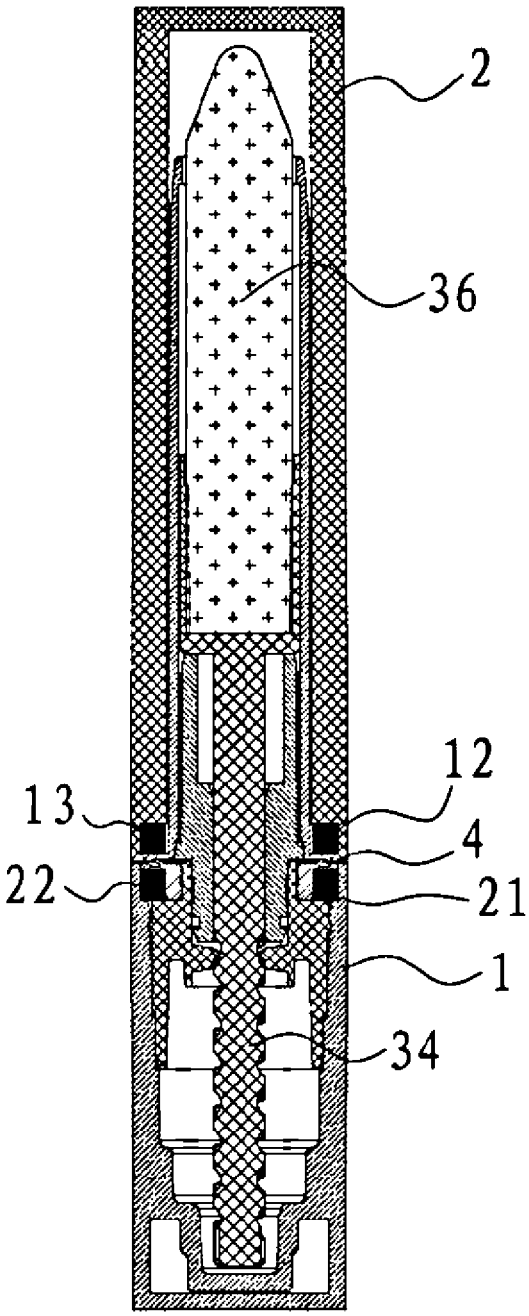
FIG. 20 is a sectional view of a cosmetic applicator according to yet another embodiment of the present invention.

As shown in FIG. 1 to FIG. 17, an embodiment of the present invention provides a cosmetic applicator. As shown in FIG. 20, the cosmetic applicator comprises a bearing member 1, a housing 2 and a cosmetic supply mechanism 3, wherein a part of the cosmetic supply mechanism 3 is arranged in a first accommodating space 11 of the bearing member 1, and the housing 2 covers on the bearing member 1 and encloses the cosmetic supply mechanism 3.

As shown in FIG. 2, FIG. 3, FIG. 10 and FIG. 11, the bearing member 1 is provided with a first connection part 21 at top, and the housing 2 is provided with a second connection part 12 at the bottom. At least one of the first connection part 21 and the second connection part 12 is a magnet, and the first connection part 21 and the second connection part 12 can be mutually attracted to each other.

An elastomeric gasket 4 is arranged between the first connection part 21 and the second connection part 12. When the first connection part 21 and the second connection part 12 are mutually attracted, the elastomeric gasket 4 is extruded to achieve air-tightness.

According to the present invention, the elastomeric gasket 4 with certain elasticity may be extruded by the force generated from the attraction between the two connection parts, thereby achieving close contact and sealing effect. Besides, the realization of sealing effect through the two connection parts with a certain attracting force may provide a user with preferable hand feel and user experience.

The elastomeric gasket 4 can be made from a rubber material, a silica gel material or any other organic polymer materials which have certain elasticity to be capable of deforming.

Typically, in order to reduce the manufacturing cost, one of the first connection part 21 and the second connection part 12 of the present invention utilizes a permanent magnet, and the other one may use a common iron ring, as long as the first connection part 21 and the second connection part 12 can be mutually attracted.

Figure 1:
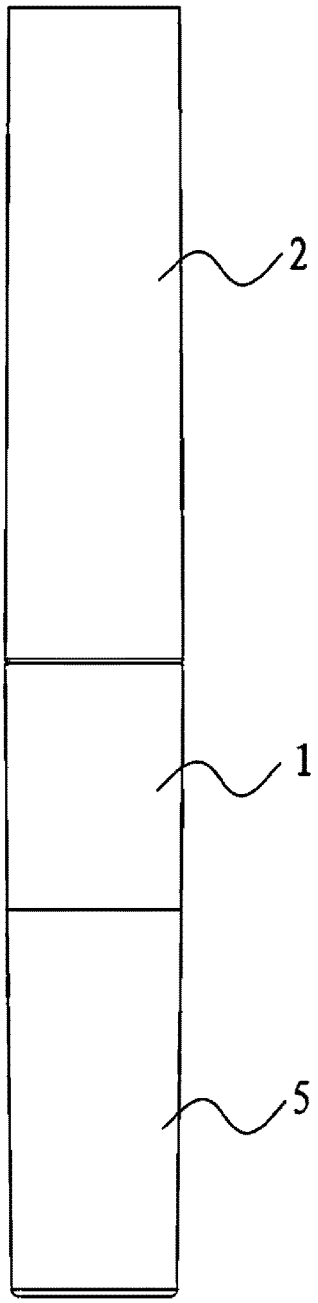
FIG. 1 is a schematic structural diagram of a cosmetic applicator according to an embodiment of the present invention.
Figure 2:
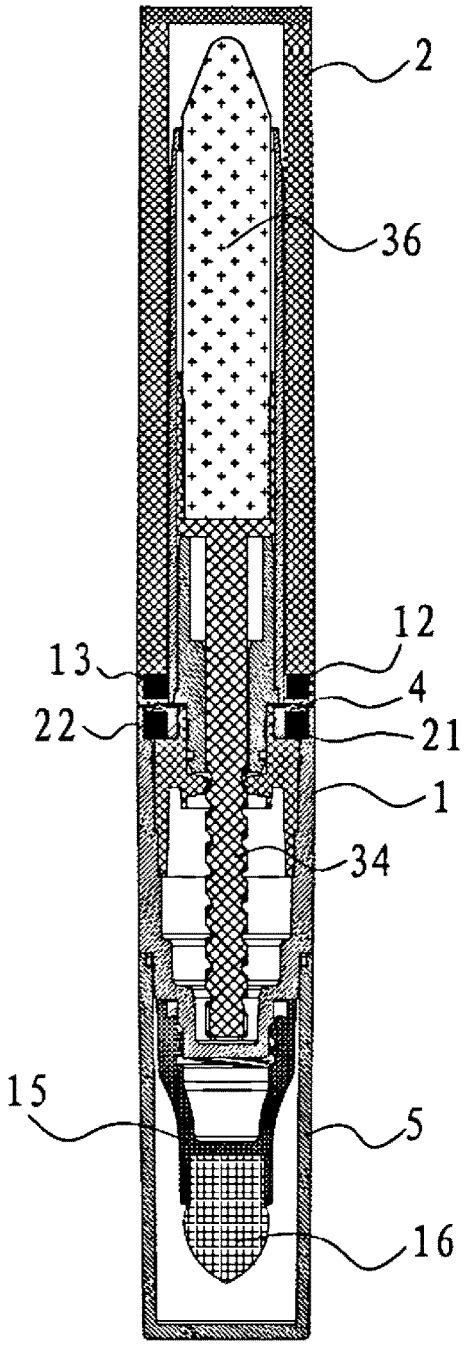
FIG. 2 is a sectional view of a cosmetic applicator according to an embodiment of the present invention.
Figure 3:
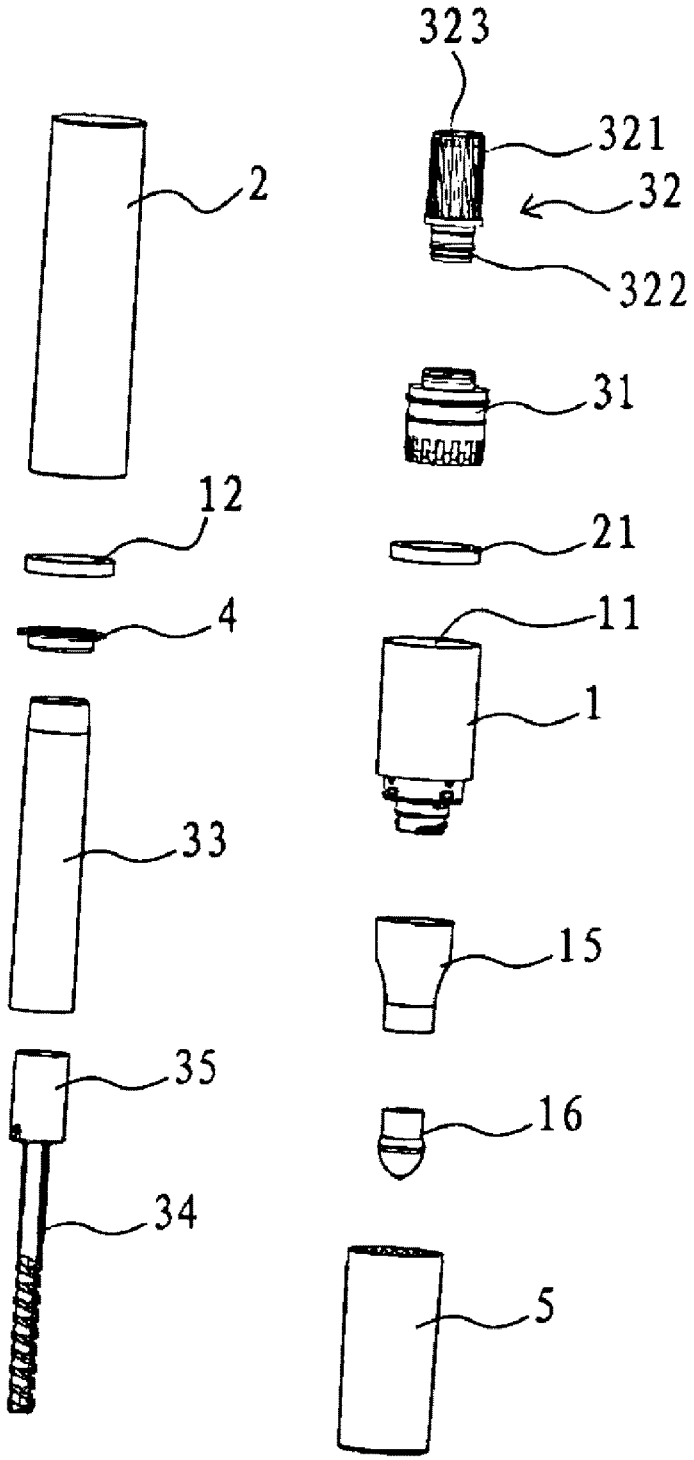
FIG. 3 is an exploded view of a cosmetic applicator according to an embodiment of the present invention.
Figure 4:
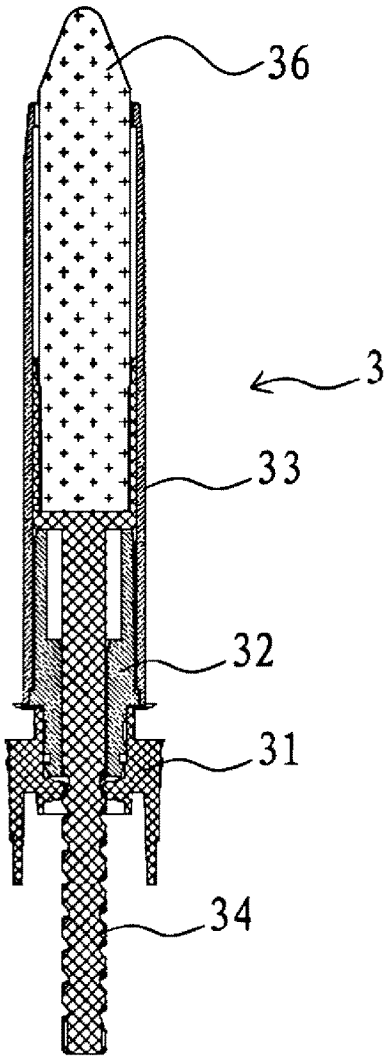
FIG. 4 is a schematic structural diagram of a cosmetic body of a cosmetic applicator according to an embodiment of the present invention.
Figure 5:
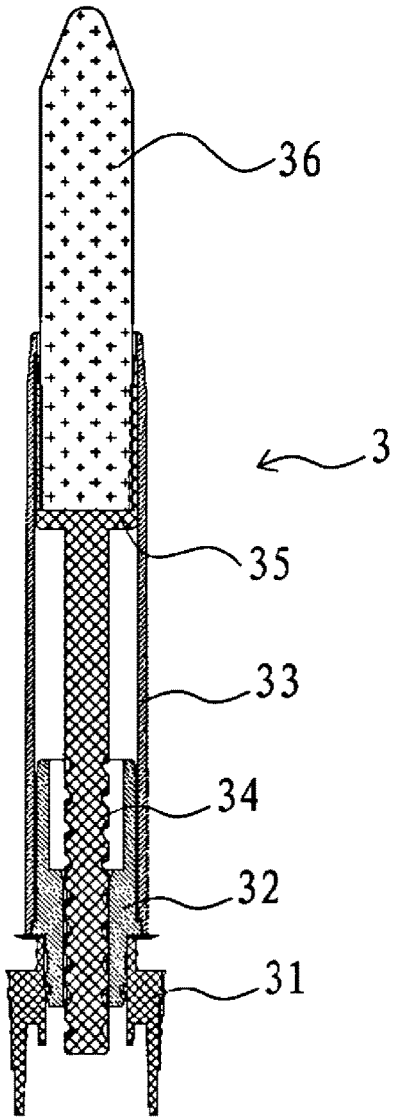
FIG. 5 is a schematic structural diagram of a cosmetic body of a cosmetic applicator according to an embodiment of the present invention, which body is in a rotation state.
Figure 10:
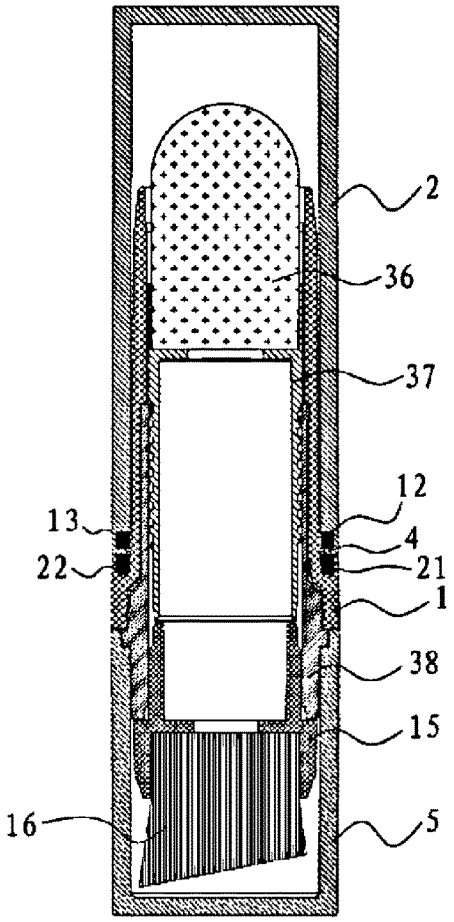
FIG. 10 is a sectional view of a cosmetic applicator according to another embodiment of the present invention.

As shown in FIG. 2 and FIG. 10, to ensure that the first connection part 21 and the second connection part 12 may be preferably fixed on the bearing member 1 and the housing 2, the bearing member 1 is provided with a first accommodating groove 22 at a position proximate to the upper opening edge of the bearing member 1, and the housing 2 is provided with a second accommodating groove 13 at a position proximate to the lower opening edge of the housing 2.

The first connection part 21 and the second connection part 12 are respectively inserted into the two accommodating grooves to ensure that the two connection parts are not prone to fall off from fixing positions.

Figure 6:
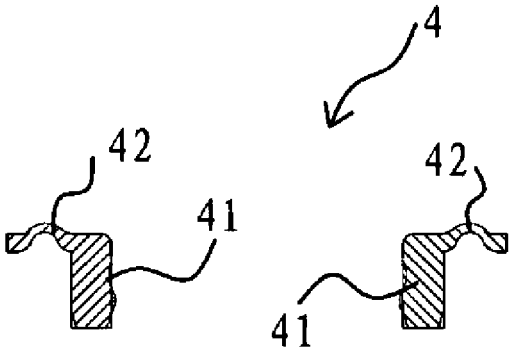
FIG. 6 is a schematic structural diagram of an elastomeric gasket of a cosmetic applicator according to an embodiment of the present invention.

As shown in FIG. 6, it shows an elastomeric gasket 4 of an embodiment of the present invention. The elastomeric gasket 4 is used for cooperating with the second connection part 12 and has a section of an "r"-shaped structure. The elastomeric gasket 4 comprises a vertical part 41 and an extending part 42 laterally extending from the side wall of the vertical part 41. The extending part 42 is of an arc-shaped structure projecting towards the second connection part 12 and covers over the first connection part 21, and the vertical part 41 is positioned at a side of the first connection part 21. In particular, the vertical part 41 may be inserted between the inside wall of the first connection part 21 and the outside wall of the bottom cover 31. In this embodiment, the elastomeric gasket 4 is disposed at the top of the bearing member 1. Of course, it may adopt a reverse configuration that the elastomeric gasket 4 is disposed at the bottom of the housing 2.

On one hand, this "r"-shaped structure can ensure a more stable mounting. On the other hand, the extending part 42, as a part of the elastomeric gasket 4, is an arc-shaped structure and it may be easier to deform under an extruding force, namely easier to realize the sealing effect.

Figure 11:
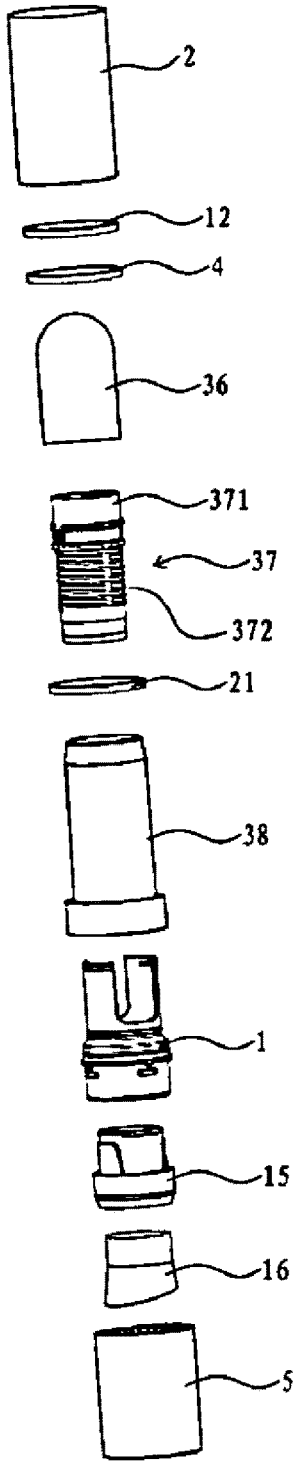
FIG. 11 is an exploded view of a cosmetic applicator according to another embodiment of the present invention.
Figure 12:
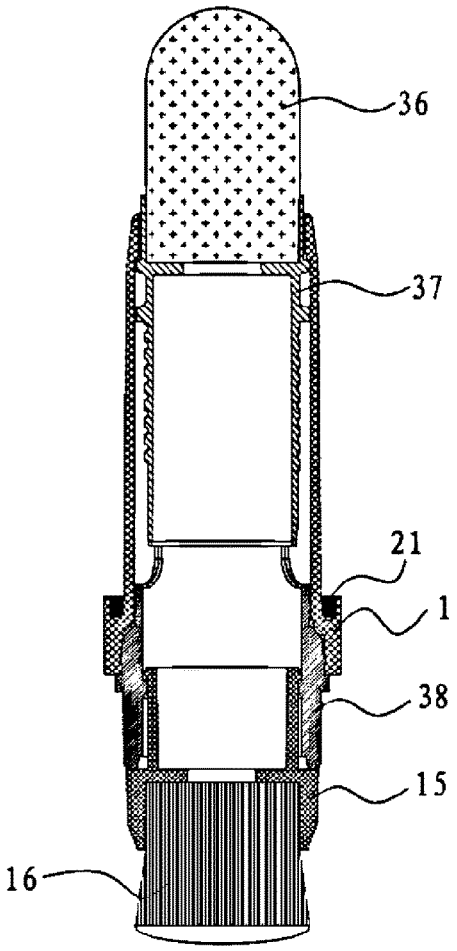
FIG. 12 is a partial schematic structural diagram of a cosmetic applicator according to another embodiment of the present invention.
Figure 13:
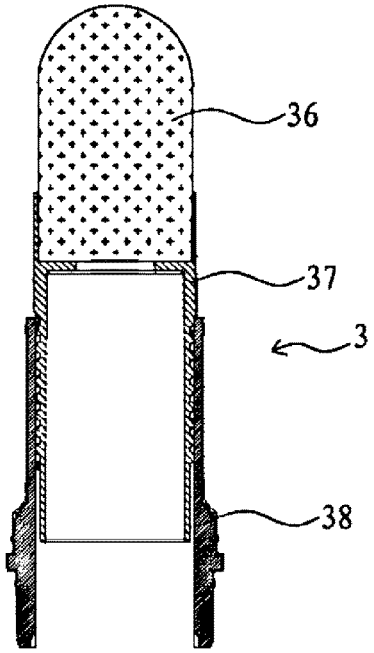
FIG. 13 is a schematic structural diagram of a cosmetic body of a cosmetic applicator according to another embodiment of the present invention.

As shown in FIG. 11, it shows an elastomeric gasket 4 of another embodiment of the present invention. The elastomeric gasket 4 in this embodiment is of an annular sheet structure, and the elastomeric gasket 4 covers and fixes onto the first connection part 21 and/or the second connection part 12. Specifically, the bonding means such as glue and double-side tape can be employed to fix the elastomeric gasket 4.

The elastomeric gasket 4 with the annular sheet structure can be easily manufactured and assembled. It may be fixed on the first and/or the second connection parts as long as the elastomeric gasket 4 can deform and generate a sealing effect under the attracting force of the first and second connection parts.

Figure 18:
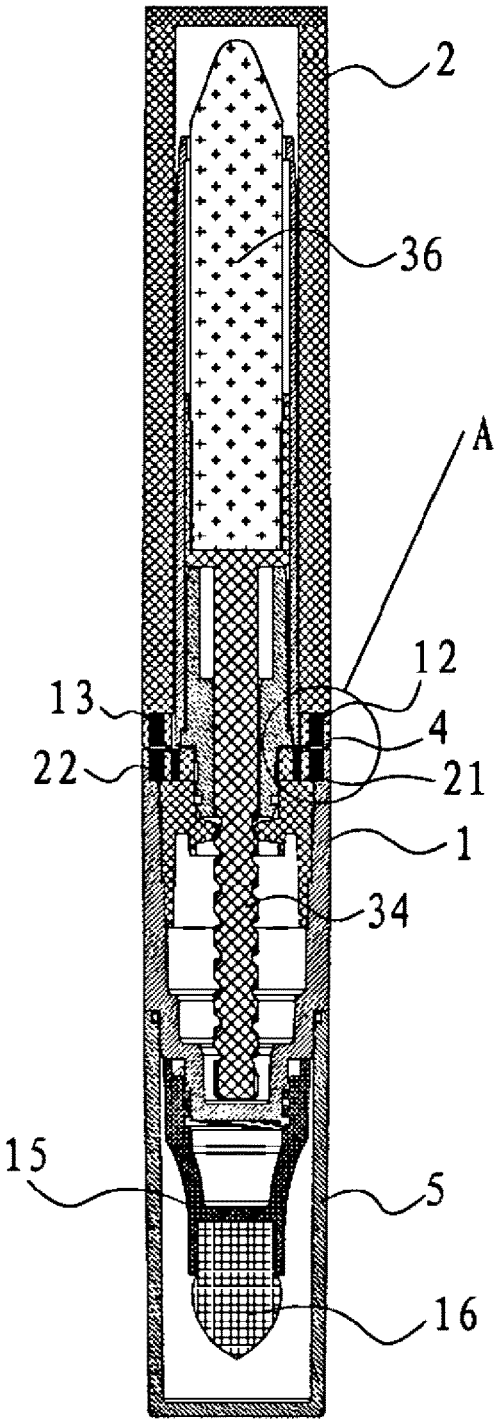
FIG. 18 is a sectional view of a cosmetic applicator according to an embodiment of the present invention.
Figure 19:
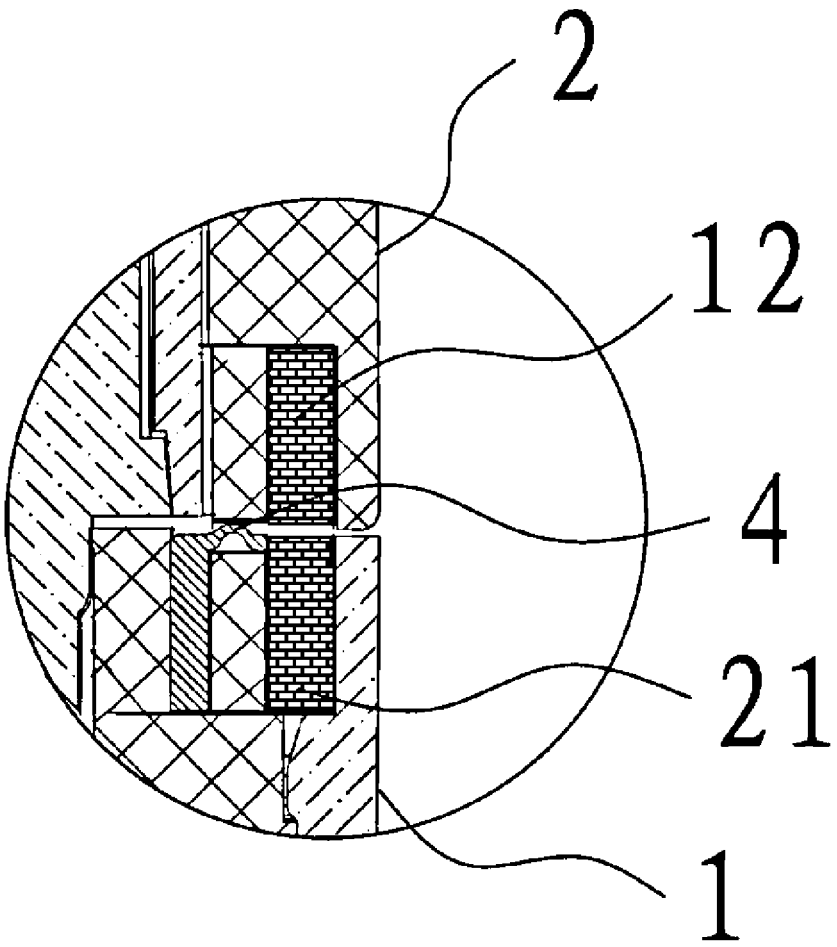
FIG. 19 is an enlarged view of the part A shown in FIG. 18.

Meanwhile, as shown in FIG. 18 and FIG. 19, the elastomeric gasket 4 in the present invention may also be positioned at the exterior of the region between the first connection part 21 and the second connection part 12. Under this situation, the first connection part 21 and the second connection part 12 can be attracted completely, without a space therebetween. After the completely attraction, more attractive force may be generated, thus ensuring the good fixation of the housing and bearing member and a more stable sealing effect of the elastomeric gasket 4, as long as the elastomeric gasket 4 can deform and create a sealing effect under the attracting force between the first and second connection parts.

As shown in FIG. 2, FIG. 3, FIG. 10 and FIG. 11, typically, in order to increase the function of the present invention, a cover body 5 may also be disposed to be connected to the bottom of the bearing member 1, and a fixed base 15 on which is arranged a cosmetic tool 16 is disposed on the bottom of the bearing member 1. The cover body 5 is used for covering the fixed base 15 and the cosmetic tools 16 thereon.

Figure 7:
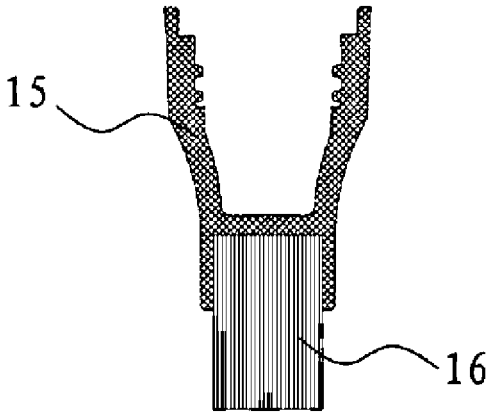
FIG. 7 is a schematic structural diagram of a cosmetic tool of a cosmetic applicator according to another embodiment of the present invention.
Figure 8:
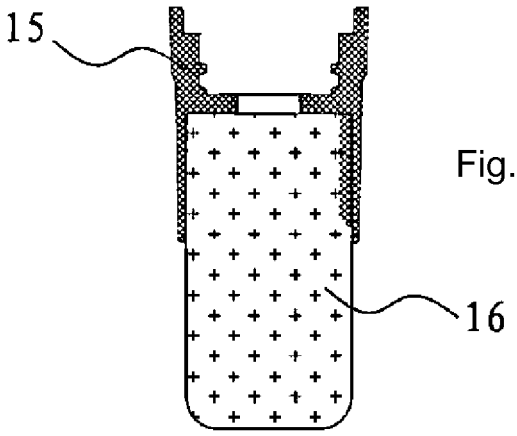
FIG. 8 is a schematic structural diagram of a cosmetic tool of a cosmetic applicator according to yet another embodiment of the present invention.
Figure 9:
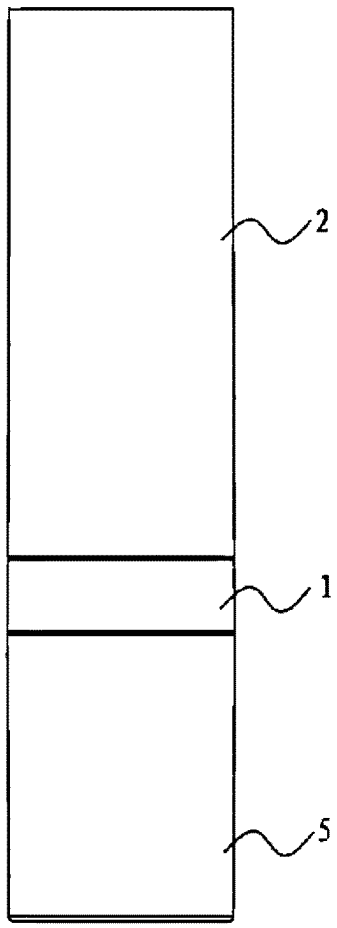
FIG. 9 is a schematic structural diagram of a cosmetic applicator according to another embodiment of the present invention.
Figure 14:
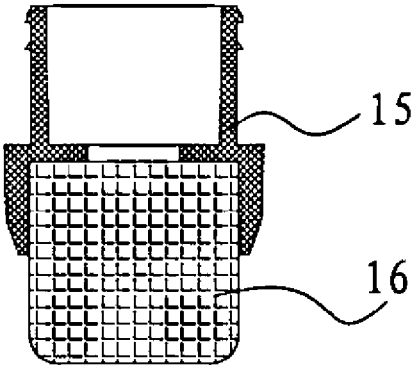
FIG. 14 is a schematic structural diagram of a cosmetic tool of a cosmetic applicator according to another embodiment of the present invention.

As shown in FIG. 7, FIG. 8 and FIG. 14, the cosmetic tool includes, but not limited to, a pencil, a brush, a wiping Q-tip or sponge body and the like.

The user may make up directly by using the pencil, the brush, the wiping Q-tip or the sponge body and the like on the bearing member 1, without additionally preparing or carrying a separate cosmetic tool, thereby bringing greater convenience to user.

Figure 15:
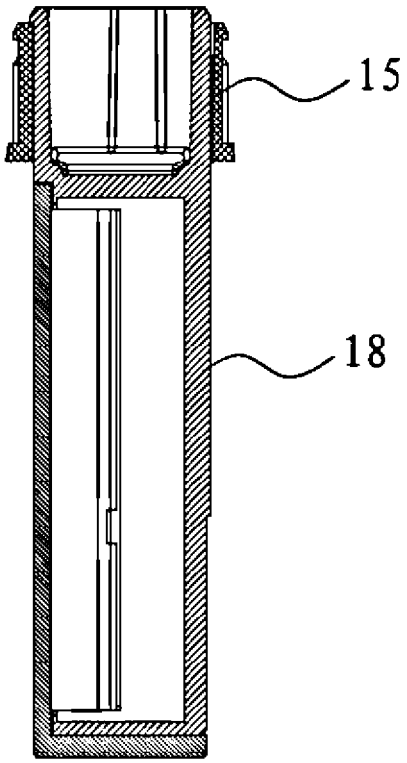
FIG. 15 is a schematic structural diagram of a storage box of a cosmetic applicator according to another embodiment of the present invention.
Figure 16:
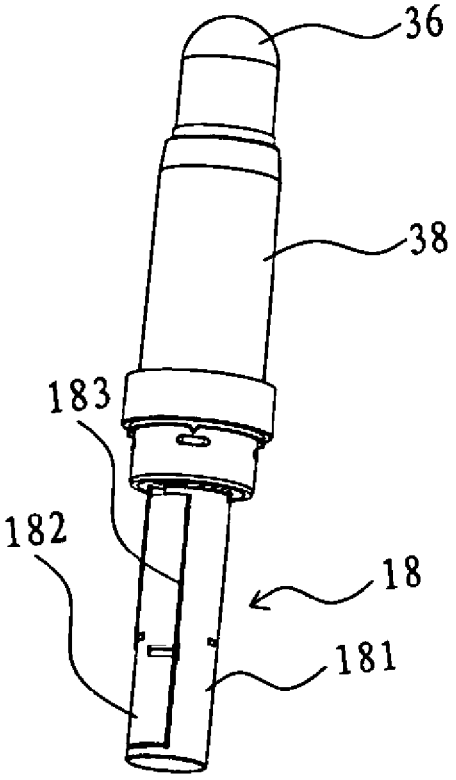
FIG. 16 is a schematic structural diagram of a storage box part, when being drawn out, of a cosmetic applicator according to another embodiment of the present invention.
Figure 17:
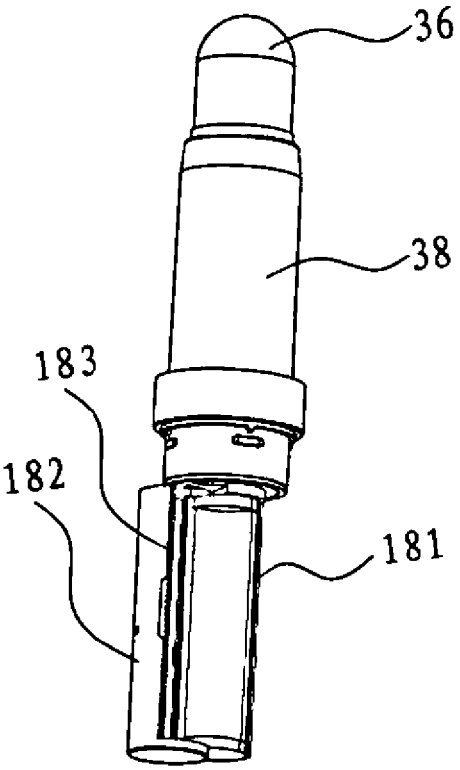
FIG. 17 is a schematic structural diagram of a storage box part, when being opened, of a cosmetic applicator according to another embodiment of the present invention.

As shown in FIG. 15, FIG. 16 and FIG. 17, they show yet another embodiment of the present invention. A storage box 18 is disposed to be inserted in the bottom of the bearing member 1, comprising a box body 181 and a box cover 182. The box cover 182 and the box body 181 fit each other and enclose an accommodating space for cosmetics. Some articles required during makeup, such as oil-absorbing sheets and the like, may be placed in the accommodating space, thereby bringing the convenience to user. Usually, the storage box 18 is inserted inside the bearing member 1 and may be drawn out when used. Typically, a cover body 5 is connected to the bottom of the bearing member 1 and used for covering the storage box 18.

In the case that the rolled oil-absorbing sheets or stacked oil-absorbing sheets are arranged in the storage box 18, cutting teeth 183 are typically arranged on one side of the box body 181 or box cover 182. The user can cut the oil-absorbing sheets through the cutting teeth 183, thus can conveniently take out a certain amount of the oil-absorbing sheets as required.

The cosmetic supply mechanism 3 of the present invention has two embodiments. The cosmetic supply mechanism 3 as shown in FIG. 2, FIG. 3, FIG. 4 and FIG. 5 comprises a bottom cover 31, a threaded pipe 32, a first sleeve 33, a threaded rod 34, a top cover 35 and a cosmetic raw material 36, wherein

- the bottom cover 31 is of a tubular structure and is sleeved in the bearing member 1;
- the threaded pipe 32 comprises a sleeving part 321 on which a convex rib 323 is arranged and
- a threaded part 322 which is sleeved inside one end of the bottom cover 31, and the threaded pipe is provided with internal threads on the inner wall mating with external threads on the threaded rod 34;

one end of the first sleeve 33 is snap-fitted with the convex rib 323 of the sleeving part 321; and the threaded rod 34 is disposed through the threaded pipe 32.

The top cover 35 is fixed at the top of the threaded rod 34. During using, the user immobilizes the first sleeve 33 in one hand and rotates the bearing member 1 by the other hand, thereby resulting in the rotation of the threaded rod 34 relative to the threaded pipe 32 and an up-and-down movement of the threaded rod 34 relative to the threaded pipe 32. Meanwhile the movement of the threaded rod 34 drives the top cover 35 to make an up-and-down movement.

The cosmetic raw material 36 is positioned inside the top cover 35 and is driven to be lifted for use when the top cover 35 is lifted.

The cosmetic raw material 36 may be hidden in the first sleeve 33 for storage when not used and be protruded out from the first sleeve 33 for use by rotating the threaded rod 34.

As shown in FIG. 10, FIG. 11, FIG. 12 and FIG. 13, they show a cosmetic supply mechanism 3 of another embodiment. The cosmetic supply mechanism 3 comprises an accommodating pipe 37, a second sleeve 38 and a cosmetic raw material 36, wherein the accommodating pipe 37 comprises an accommodating cavity 371 and a threaded sleeve 372; and the threaded sleeve 372 is provided with external threads on the outer side wall mating with internal threads on the inner wall of the second sleeve 38.

When the second sleeve 38 rotates, the threaded sleeve 372 can make an up-and-down movement relative to the second sleeve 38, which movement drives the accommodating cavity 371 to make an up-and-down movement meanwhile.

The cosmetic raw material 36 is positioned in the accommodating cavity 371 and is driven to be lifted for use when the accommodating cavity 371 is lifted.

The cosmetic raw material 36 may be hidden in the accommodating pipe 37 for storage when not used and be protruded out from accommodating pipe 37 for use by rotating the bearing member 1 which drives the rotation of the second sleeve 38.

The above descriptions are only some illustrative embodiments of the present invention. For the person skilled in the art, various modifications and improvements, without departing from the inventive concept of the present invention, may be made to the embodiments and they all fall into the protective scopes of the present invention.

What is claimed is:

1. A cosmetic applicator, comprising:

a cosmetic supply mechanism;

a bearing member to carry the cosmetic supply mechanism;

a housing for forming a closed cavity together with bearing member to enclose the cosmetic supply mechanism disposed therein, the housing and the bearing member being designed to be connected edge to edge;

characterized in that, the bearing member and the housing respectively have a first connection part and a second connection part for magnetic connection, and the first connection part and the second connection part is positioned respectively at the end of the bearing member and of the housing;

and that the cosmetic applicator further comprises a elastomeric gasket, and the first connection part, the second connection part and the elastomeric gasket are configured so that the elastomeric gasket can be extruded to deform and fill a gap between the ends of the housing and the bearing member when the ends are mutually attracted;

wherein the elastomeric gasket is mated with the second connection part and has a section being of an "r"-shaped structure: and the elastomeric gasket comprises a vertical part and an extending part laterally extending from the vertical part: the extending part is of an arc-shaped structure projecting towards the second connection part and covers over the first connection part; the vertical part is positioned at a side of the first connection part and the extending part of the elastomeric gasket is positioned between the first connection part and the second connection part.

2. The cosmetic applicator according to claim 1, wherein the bearing member is provided with a first accommodating groove at a top of the bearing member for accommodating the first connection part, and the housing is provided with a second accommodating groove at a bottom of the bearing member for accommodating the second connection part.

3. The cosmetic applicator according to claim 1, wherein the bearing member is provided at a bottom thereof with a fixed base on which is arranged a cosmetic tool, and the bottom is connected with a cover body.

4. The cosmetic applicator according to claim 1, wherein the bearing member is inserted at a bottom thereof with a storage box comprising a box body and a box cover cooperating with each other and enclosing an accommodating space for cosmetics, and the bottom is connected with a cover body.

5. The cosmetic applicator according to claim 4, wherein the storage box stores a roll/stack of oil-absorbing sheets, and the box body or box cover is provided on one side with cutting teeth.

6. The cosmetic applicator according to claim 1, characterized in that the cosmetic supply mechanism comprises a bottom cover having a tubular structure and sleeved in the bearing member, a threaded pipe comprising a sleeving part with a convex rib and a threaded part sleeved inside one end of the bottom cover, a first sleeve which is in bayonet connection with the convex rib at one end, a threaded rod within the threaded pipe, which has external threads thereon mating with internal threads on an inner wall of the threaded pipe, a top cover fixed at a top of the threaded rod, which can be brought into an up-and-down movement through an up-and-down movement of the threaded rod relative to the threaded pipe resulting from the rotation of the threaded rod, and a cosmetic raw material positioned inside the top cover, which can be lifted and lowered accompanying with the up-and-down movement of the top cover.

7. The cosmetic applicator according to claim 1, wherein the cosmetic supply mechanism comprises an accommodating pipe comprising an accommodating cavity and a threaded sleeve which is provided with external threads on an outer side wall, a second sleeve which is provided with internal threads on an inner wall mating with the external threads of the threaded sleeve, when the second sleeve rotates, the threaded sleeve can make an up-and-down movement relative to the second sleeve, thereby bringing an up-and-down movement of the accommodating cavity, a cosmetic raw material positioned in the accommodating cavity, which can be lifted and lowered accompanying with the up-and-down movement of the accommodating cavity.

8. The cosmetic applicator according to claim 1, wherein the elastomeric gasket is positioned at an exterior of a region between the first connection part and the second connection part.

* * * * *